United States Patent [19]

Bhattacharyya et al.

[11] 4,409,044

[45] Oct. 11, 1983

[54] WATER-IN-OIL EMULSION EXPLOSIVES AND A METHOD FOR THE PREPARATION OF THE SAME

[75] Inventors: Dhirendra N. Bhattacharyya, Maharashtra; Srinivasachari Seshan, Giridih; John S. Campbell, Maharastra; Soumendranath Sen, Giridin, all of India

[73] Assignee: Indian Explosives Limited, Calcutta, India

[21] Appl. No.: 442,670

[22] Filed: Nov. 18, 1982

[51] Int. Cl.[3] ..... C06B 45/00

[52] U.S. Cl. ..... 149/2; 149/21; 149/46; 149/60; 149/61; 149/92; 149/109.6

[58] Field of Search ..... 149/2, 21, 46, 60, 61, 149/109.6, 92

[56] References Cited

U.S. PATENT DOCUMENTS

| | | | |
|---|---|---|---|
| 4,287,010 | 9/1981 | Owen | 149/2 |
| 4,310,364 | 1/1982 | Ekman et al. | 149/2 |
| 4,315,784 | 2/1982 | Hattori et al. | 149/2 |
| 4,322,258 | 3/1982 | Sudweeks et al. | 149/2 |
| 4,326,900 | 4/1982 | Hattori et al. | 149/2 |
| 4,356,044 | 10/1982 | Jessop et al. | 149/2 |
| 4,357,184 | 11/1982 | Binet et al. | 149/2 |

*Primary Examiner*—Stephen J. Lechert, Jr.
*Attorney, Agent, or Firm*—Cushman, Darby & Cushman

[57] ABSTRACT

A water-in-oil explosives composition comprising water, liquid or liquefiable carbonaceous fuel and inorganic oxidizer salt, optionally with gassing agent and/or thickening agent, and containing 0.02 to 2% of a stabilizer selected from organo-sulphur compounds, organic compounds containing quaternary nitrogen, phenolic compounds and substituted derivatives thereof, dihydroxybenzenes, quinones, unsubstituted and substituted aryl diazo compounds, unsubstituted and substituted aryl amines and salts thereof, and unsubstituted and substituted quinolines. Preferred stabilizers include thioureo, hydroquinone, anthraquinone, 1-phenylazo-2-naphthol, 1-[(4'-o-tolylazo)-o-tolylazo]-2-naphthol, N-phenyl-α-naphthylamine, N-phenyl-β-naphthylamine, the condensation products of 1,4 dichloroanthraquinone with p-toluidine and 2,2,4-trimethyl-1,2-dihydroquinolines.

The compositions have improved sensitivity and stability against phase separation at elevated temperatures and under cycling temperature conditions between −16° and +50° C.

10 Claims, 6 Drawing Figures

I

II

III

IV

V

VI

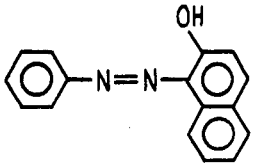
I
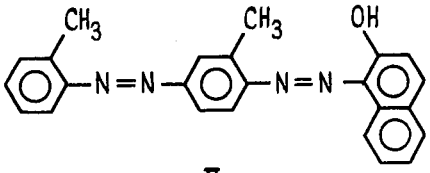
II
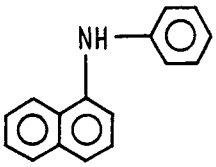
III
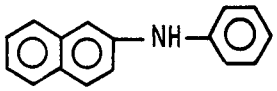
IV
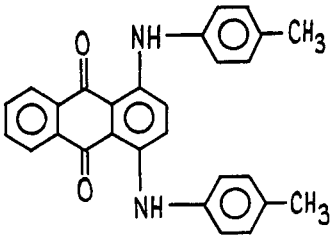
V
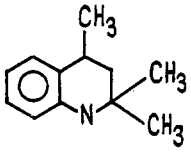
VI

WATER-IN-OIL EMULSION EXPLOSIVES AND A METHOD FOR THE PREPARATION OF THE SAME

The present invention relates to cap-sensitive water-in-oil explosives compositions. In particular, it relates to an improved water-in-oil emulsion explosives composition without containing any self-explosive ingredient and/or detonation catalyst and/or inorganic perchlorates and/or any sensitizer other than occluded gas hereinafter referred to as 'water-in-oil emulsion explosives composition' and a method for producing the same.

More particularly, the invention relates to explosive compositions having sensitivity to initiation by as low as No. 6 strength commercial detonator in diameters down to 20 mm at temperatures down to 0° C. which can withstand a continuous hot storage at 50° C. as well as a cycling temperature condition between −16° C. and +50° C. and a varying humidity condition for a prolonged storage period, thereby exhibiting distinct improvement in stability and sensitivity. These are therefore eminently suitable for widely varying tropical climate usage conditions both as permitteds in underground coalmines and also as a general purpose explosive for small diameter as well as large diameter packaged and/or bulk applications.

Emulsion explosive compositions are recently gaining wide acceptance in the explosive industry in view of their inherent safety, ease of manufacture and handling. However, the compositions in the prior art suffer from inadequate sensitivity and stability under widely varying temperature and humidity conditions on prolonged storage. Until recently, water-in-oil emulsion explosives generally comprised blasting agents requiring boosters. In order to achieve cap-sensitivity, emulsion explosives have been prepared in the past by the addition of a self-explosive ingredient or a specific detonation catalyst such as alkali metal perchlorates.

Examples of these types of cap-sensitive emulsion explosives are described in the U.S. Pat. No. Re. 28,060, U.S. Pat. No. 3,770,522 and U.S. Pat. No. 3,765,964. Recently, however, cap-sensitive water-in-oil emulsion explosive without containing any self-explosive ingredient or a detonation catalyst has been formulated by incorporating glass or plastic hollow microspheres as sensitiser. Such cap-sensitive water-in-oil emulsion explosive compositions are described in detail in the U.S. Pat. Application Ser. No. 740,094 filed on Nov. 9, 1977.

U.S. Pat. No. 4,149,916 discloses that water-in-oil emulsion explosive can be prepared without the use of conventional high explosives, detonation catalysts or hollow microspheres henceforth called 'microballoons' but having perchlorates and occluded air in the composition, while U.S. Pat. No. 4,149,917 claims that cap-sensitivity of the composition can be achieved without the use of any sensitiser other than occluded air. According to the said patent specification, the air is occluded within the explosive composition by means of a suitable mixing device such as that disclosed in U.S. Pat. No. 3,642,547 and the density of the product can be changed as desired by changing the flow rate of the gas stream entering the system. One inherent drawback of such blasting composition is that if the discharge density of the emulsions is not less than 1.0 g/ml these will not retain the sensitivity to a No. 6 strength detonator after ageing for as low as 24 hours which poses a serious limitation to the useful life and drastically restricts the use conditions.

In addition, while such compositions in the fresh conditions become more sensitive to detonation as the density decreases, other things being equal, they also lose bulk strength (available energy per unit volume) in proportion to the reduction in density, in the borehole.

Apparently, these tiny air bubbles present inside such emulsions act as hot spots or activator sites to promote detonation. The increase in the density due to the hydrostatic head invariably results in marked densensitisation of the explosive caused particularly after long storage. Various suggestions have been made in the prior art to compensate for decrease in sensitivity either through proportional gassing or by incorporation of inorganic perchlorate(s) as a component of the inorganic oxidiser salt portion of the emulsion explosives composition.

There are practical difficulties in the methods of such gassing and there are inherent hazards in the handling of perchlorate(s). Therefore, need was felt for water-in-oil emulsion explosive compositions which are cap-sensitive without the use of involved gassing methods or without the addition of hazardous perchlorates in the composition, yet are characterized by good detonatability at low as well as high temperature and stability on prolonged storage. In addition to the need for the presence of fine gas/air bubbles in sufficient number and of right size to achieve such objective, close control of population of emulsion droplets and their distribution and size is found to be equally, if not more important. This has been partly achieved by using certain polymeric emulsifiers. Nevertheless, use of such polymeric emulsifiers in water-in-oil emulsion explosive compositions was found to exhibit a shelf life in the temperature range of 0° C. to 50° C. for a period of 6 months and cannot exhibit prolonged stability under low temperature cycling between −16° C. to +50° C., thus posing a ceiling to the varying application conditions.

The object of the present invention is to overcome the aforesaid limitations and to enhance the stability of emulsion explosives both in terms of consistency and sensitivity.

Accordingly, this invention provides an improved water-in-oil emulsion explosives composition which comprises (by weight) (i) 5 to 30% of water, (ii) 3 to 15% of a water-insoluble emulsifiable, liquid or liquefiable carbonaceous fuel, (iii) 20 to 80% of inorganic oxidiser salt such as ammonium nitrate, calcium nitrate, sodium nitrate or potassium nitrate, either singly or in combination of two or more of them, (iv) optionally 0.02 to 0.5% of a gassing agent such as sodium nitrite or a nitroso compound such as N, N'-dinitroso pentamethylene tetramine (DNPT), (v) 0.5 to 4% of emulsifier, (vi) optionally water- and/or fuel-soluble thickening agent, flame quenching coolant and/or metallic/-particulate fuel, and (vii) 0.02 to 2% of a stabiliser selected from the group consisting of organo-sulphur compounds such as thiocarbamides, mercaptans and their derivatives, organic compounds containing quarternary nitrogen such as alkyl and/or aryl quarternary ammonium salts and/or alkyl/aryl pyridinium salts, phenolic compounds and substituted derivatives thereof such as styrenated phenols, dihydroxybenzenes such as hydroquinone, quinones such as benzoquinone, naphthaquinone and anthraquinone, unsubstituted and substituted aryl diazo compounds, unsubstituted and substituted aryl amines and salts thereof, unsubstituted any substituted quinolines and mixtures of any two or more of said stabilisers.

An especially preferred thiocarbamide is thiourea. Preferred aryl diazo compounds include compounds of the general formula $$X_1Ar_1-N=N-Ar_2X_2 \text{ and } X_1Ar_1-N=N-\underset{\underset{X_2}{|}}{Ar_2}-N=NAr_3X_3$$

wherein $Ar_1$, $Ar_2$ and $Ar_3$ are aryl groups such as phenyl or naphthyl and which may be the same or different, and $X_1$, $X_2$ and $X_3$ are hydrogen, hydroxyl or alkyl groups and may be the same or different. Examples of this class of compound which have been found to be especially effective in the present invention are the diazo dyes 1-phenylazo-2-naphthol of the formula I of the accompanying drawings and 1-[(4'-o-tolylazo)-o-tolylazo] -2-naphthol of formula II of the accompanying drawings.

Preferred aryl amines include the secondary amines of the general formula $$Ar_1-\underset{\underset{H}{|}}{N}-Ar_2,\ X_1Ar_1-\underset{\underset{H}{|}}{N}-Ar_2X_2,\ H_2N-Ar-NH_2 \text{ and } \underset{\underset{H}{|}}{Ar_1N}-Ar-\underset{\underset{H}{|}}{N_1}Ar_2$$

wherein Ar, $Ar_1$ and $Ar_2$ are aryl groups which may be the same or different and $X_1$ and $X_2$ are hydrogen or alkyl groups which may be the same or different. Examples of these compounds found to be especially effective in the present invention are N-phenyl-$\alpha$-naphthylamine of formula III of the accompanying drawings and N-phenyl-$\beta$-naphthylamine of formula IV of the accompanying drawings and the condensation product of one mole of 1,4 dichloroanthraquinone with two moles of p-toluidine having the formula V of the accompanying drawings.

Preferred quinolines include 2,2,4-trimethyl-1,2-dihydroquinoline having the formula VI of the accompanying drawings and polymers thereof.

The stabilisers by themselves have a pronounced stabilising effect in water-in-oil emulsion explosive of the present invention. However, the stabilising efficiency as well as the long term shelf life is in some cases enhanced and supplemented when the stabiliser is used along with a hydrocolloid such as guar gum.

The carbonaceous fuel component of the emulsion explosive composition may include most hydrocarbons, for example, paraffinic, olefinic, napthenic, aromatic, saturated or unsaturated hydrocarbons including halogenated ones. In general, the carbonaceous fuel is a water-immiscible emulsifiable fuel which is either liquid or liquefiable at a temperature up to about 85° C. and preferably below 65° C. It is preferable that the emulsion comprises from about 3 to about 10% by weight of fuel and that the fuel includes mineral/vegetable oils, waxes, aromatic/alicyclic hydrocarbons as such or in combination along with a suitable emulsifier or a blend of emulsifiers. Examples of suitable waxes include those derived from petroleum such as petroleum wax, microcrystalline wax, paraffin wax and also various waxes of animals and insect origin. Examples of suitable oils include the various petroleum oils, vegetable oils, dinitrotoluenes, highly refined mineral oils and also synthetic mixtures of hydrocarbons and their derivatives.

The emulsifier used is preferably an oil-soluble emulsifier(s) of low HLB (Hydrophillic Lipophillic Balance) value (less than 10) such as those derived from sorbitol by esterification, for example, sorbitan monolaurate, sorbitan mono-oleate, sorbitan sesqui-oleate, sorbitan trioleate, sorbitan monostearate and sorbitan tristearate. Other useful emulsifiers include mono- and diglycerides of fat forming fatty acids, phospholipids such as lecithin, polymeric surfactants based on the condensation of hydroxy stearic acid and polyethylene glycols of various molecular weights and 2-(8-heptadecenyl) -4,4'-bis-(hydroxymethyl)-2-oxazoline. Suitable combinations of monomeric emulsifiers like sorbitan ester(s) and polymeric surfactants as stated above are preferred for the subject invention with respect to fineness and uniform droplet size of emulsions, large droplet population, good storage consistency and satisfactory sensitivity. Generally at least 0.5% emulsifier is added to form a good emulsion but larger amounts are preferred for stability. From a practical standpoint, however, based primarily on economics and for technical consideration of what is known as critical micelle concentration (CMC), usually not more than 4% emulsifier(s) is used. For most applications, the amount of emulsifier present in the composition is 1 to 2%—all the amounts being weight by weight basis. The emulsifier(s) optionally might contain certain crystal habit modifiers known in prior art, such as alkali metal salts of carboxy methyl cellulose, salts of long chain amines, and the condensation product of formaldehyde and napthalene sulphonic acid.

The inorganic oxidiser salts will generally comprise ammonium nitrate, $Ca(NO_3)_2$, $KNO_3$ or $NaNo_3$ or mixtures thereof. The composition preferably contains 30% to 80% by weight ammonium nitrate, and when one or more other nitrate(s) stated above are present the amount of these preferably does not exceed 30% by weight.

Preferred 'gassing' agents include sodium nitrite on a nitrosoamine such as dinitroso pentamethylene tetramine (DNPT) conveniently in an amount suitable for achieving the density in the range of 1.0 to 1.20 g/cc. The concentration of the gassing agent preferably is in the range from 0.05 to 0.5%, the preferred concentration being about 0.2%.

Thickening agents optionally used for viscosity build-up of the emulsion of the invention and for its improved consistency include various natural gums, synthetic polymeric hydrocolloids like polyacrylamides of their derivatives compatible with the system. Of the natural gums, the most effective ones are guar gum, gum tragacanth, gum arabic, and karaya gum. The thickening agents are preferably present in low concentrations—usually between 0.05 to 1%, the preferred concentration being about 0.4% (w/w) based on the total composition. Cross-linking agents for cross-linking guar gum as known in the prior art may be added in trace amounts and usually comprise salts of metals such as those of zinc, chromium or antimony. For controlled cross-linking, a cross-link delaying agent may be present optionally and usually this consists of tartaric acid or its salts. The immiscible continuous fuel phase of the composition can also be thickened, if desired, by use of a thickening agent(s) which functions in an organic liquid.

This invention also provides a method for the preparation of an improved water-in-oil emulsion explosives composition which comprises the steps of premixing the water-soluble ingredients (other than the gassing agent) in water into a first premix and the oil-soluble ingredients in the carbonaceous fuel into a second premix, heating the aqueous premix till a clear solution is obtained, heating the second premix separately to approximately the same temperature to which the first premix is heated, blending the first and second premixes at the same temperature with stirring until a uniform mixture results, cooling down to about 40° C., adding the gassing agent into the mixture, and stirring the final mixture till the gassing agent is uniformly dispersed.

Generally, the carbonaceous fuel, thickening agent (if present) and emulsifier will be in the second premix and the stabilising agents may be incorporated in either of the premixes, oil phase or aqueous phase, depending on their compatibility. The first premix is generally heated to about 45° to 80° C. depending on the fudge point of the salt solution until the salts are completely dissolved. The premixes may be blended in a conventional mixer and, when the emulsification starts, the mix is cooled with continuous stirring until the mixture is uniform and cooled down to around 40° C. before adding the gassing agent. The emulsion explosive compositions thus formed may be either packaged or bulk loaded.

Thus, it is found that water-in-oil emulsion explosive compositions of improved shelf-life can be made by employing the usual ingredients such as hydrocarbon fuels, water, inorganic nitrates, but without any detonation catalyst/self explosive/sensitisers, other than occluded gas, and incorporating therein certain stabiliser(s) as described above.

Emulsions may be prepared in accordance with the invention which exhibit good consistency, very fine (less than 10 micrometers) emulsion droplet size, uniform droplets distribution and sensitivity to initiation by a No. 6 commercial blasting cap down to 0° C. at diameters down to 20 mm after being stored for more than six months. The conventional sensitisers utilised in compositions mentioned in the prior art that are not required in the subject invention include paint/flake grade aluminium, carbon black, copper chloride, zinc chloride, high explosives, smokeless powder and the like.

The invention is further illustrated by the following Examples.

EXAMPLES

The compositions set forth in Tables 1 and 2 are prepared by mixing a premix of water-soluble ingredients in water with a second premix of the oil-soluble components with carbonaceous fuel(s) both premixes being at an elevated temperature (between 50° C. and 85° C.), the first premix being added to the second one with agitation. Once the emulsification takes place, the material is cooled progressively to achieve a good homogenous consistency. Optional ingredients such as metallic fuel(s), additional inorganic oxidiser salts, coolants etc. are then added if required and finally the gassing agent is uniformly dispersed with the final mix to achieve improved water-in-oil emulsion explosives of the present invention.

The emulsifier is a mixture of 7 parts by weight of sorbitan mono-oleate, 7 parts by weight of soya lecithin and 3 parts by weight of polymeric surfactant based on poly-12-hydroxy stearic acid and polyethylene glycol.

The velocity of detonation quoted in the tables is that of a 25 mm diameter cartridge fired with a No. 6 detonator.

TABLE 1

| Example No. | 1 | 2 | 3 | 4 | 5 | 6 | 7 | 8 |
|---|---|---|---|---|---|---|---|---|
| Ingredients % by weight | | | | | | | | |
| Ammonium Nitrate | 59.2 | 59.1 | 58.8 | 58.7 | 58.2 | 55.0 | 58.7 | 58.7 |
| Sodium/Potassium/ Calcium Nitrate(s) | 16.6 | 16.6 | 16.6 | 16.6 | 16.6 | 16.0 | 16.6 | 16.6 |
| Water | 18.0 | 18.0 | 18.0 | 18.0 | 18.0 | 18.0 | 18.0 | 18.0 |
| Paraffin Wax | 2.0 | 2.0 | 2.0 | 2.0 | 2.0 | 1.8 | 2.0 | 2.0 |
| Paraffin/Diesel Oil | 2.0 | 2.0 | 2.0 | 2.0 | 2.0 | 2.0 | 2.0 | 2.0 |
| Chlorinated Paraffin | 0.5 | 0.5 | 0.5 | 0.5 | 0.5 | 0.5 | 0.5 | 0.5 |
| Thiourea | — | 0.1 | — | 0.1 | 0.1 | 0.1 | — | — |
| Hydroquinone | — | — | — | — | — | — | 0.1 | — |
| Anthraquinone | — | — | — | — | — | — | — | 0.1 |
| Guar Gum | — | — | 0.4 | 0.4 | 0.4 | 0.4 | 0.4 | 0.4 |
| Potassium Chloride (Coolant) | — | — | — | — | — | 4.0 | — | — |
| Emulsifier(s) | 1.5 | 1.5 | 1.5 | 1.5 | 2.0 | 2.0 | 1.5 | 1.5 |
| Sodium Nitrate (Gassing Agent) | 0.2 | 0.2 | 0.2 | 0.2 | 0.2 | 0.2 | 0.2 | 0.2 |
| Properties | | | | | | | | |
| Discharge density (g/ml) | 1.10 | 1.05 | 1.1 | 1.0 | 1.05 | 1.05 | 1.0 | 1.0 |
| Velocity of detonation (km/sec.) | 3.5 | 3.5 | 3.5 | 3.5 | 3.5 | 3.5 | 3.5 | 3.5 |
| Cap sensitivity after dry storage at 50° C. | | | | | | | | |
| 2 weeks | P | P | P | P | P | P | P | P |
| 4 weeks | F | F | F | P | P | P | P | P |
| 8 weeks | F | F | F | P | P | P | P | P |
| 16 weeks | F | F | F | P | P | P | P | P |
| 24 weeks | F | F | F | P | P | P | P | P |
| Stability | | | | | | | | |
| (a) Dry storage at 50° C. | | | | | | | | |
| 1 Week | St | St | St | St | St | St | St | St |
| 2 Weeks | PS | " | " | " | " | " | " | " |
| 4 Weeks | | " | PS | " | " | " | " | " |
| 8 Weeks | | " | | " | " | " | " | " |
| 16 Weeks | | " | | " | " | " | " | " |
| 24 Weeks | | " | | " | " | " | " | " |

TABLE 1-continued

| Example No. | 1 | 2 | 3 | 4 | 5 | 6 | 7 | 8 |
|---|---|---|---|---|---|---|---|---|
| (b) Cycling −16° C. to +50° C. | | | | | | | | |
| 1 Cycle | PS | St | St | St | St | St | St | St |
| 2 Cycle | | " | " | " | " | " | " | " |
| 4 Cycle | | " | " | " | " | " | " | " |
| 8 Cycle | | " | PS | " | " | " | " | " |
| 16 Cycle | | " | | " | " | " | " | " |
| 24 Cycle | | " | | " | " | " | " | " |
| 32 Cycle | | " | | " | " | " | " | " |

P = Passing F = Failing PS = Phase Separation St = Stable

TABLE 2

| Example No. | 9 | 10 | 11 | 12 | 13 | 14 | 15 | 16 |
|---|---|---|---|---|---|---|---|---|
| Ingredients % by weight | | | | | | | | |
| Ammonium Nitrate | 59.3 | 59.1 | 59.1 | 59.1 | 59.1 | 59.1 | 55.1 | 59.1 |
| Sodium/Potassium/ Calcium Nitrate(s) | 16.6 | 16.6 | 16.6 | 16.6 | 16.6 | 16.6 | 16.6 | 16.6 |
| Water | 18.0 | 18.0 | 18.0 | 18.0 | 18.0 | 18.0 | 18.0 | 18.0 |
| Paraffin Wax | 2.0 | 2.0 | 2.0 | 2.0 | 2.0 | 2.0 | 2.0 | 2.0 |
| Paraffin/Diesel Oil | 2.0 | 2.0 | 2.0 | 2.0 | 2.0 | 2.0 | 2.0 | 2.0 |
| Chlorinated Paraffin Wax | 0.5 | 0.5 | 0.5 | 0.5 | 0.5 | 0.5 | 0.5 | 0.5 |
| Emulsifier(s) | 1.5 | 1.5 | 1.5 | 1.5 | 1.5 | 1.5 | 1.5 | 1.5 |
| Stabiliser - A | — | 0.2 | — | — | — | — | — | — |
| Stabiliser - B | — | — | 0.2 | — | — | — | — | — |
| Stabiliser - C | — | — | — | 0.2 | — | — | — | — |
| Stabiliser - D | — | — | — | — | 0.2 | — | — | — |
| Stabiliser - E | — | — | — | — | — | 0.2 | 0.2 | — |
| Stabiliser - F | — | — | — | — | — | — | — | 0.2 |
| Potassium/Sodium Chloride | — | — | — | — | — | — | 4.0 | — |
| Sodium Nitrite (Gassing Agent) | 0.1 | 0.1 | 0.1 | 0.1 | 0.1 | 0.1 | 0.1 | 0.1 |
| Properties | | | | | | | | |
| Discharge density (g/ml) | 1.1 | 1.05 | 1.05 | 1.05 | 1.1 | 1.05 | 1.05 | 1.05 |
| Velocity of Detonation (km/sec) (fresh condition) | ← | ← | ← | 4.5 to 5.5 | | → | → | → |
| Cap sensitivity after dry storage at 50° C. | | | | | | | | |
| 2 weeks | P | P | P | P | P | P | P | P |
| 4 weeks | F | P | P | P | P | P | P | P |
| 8 weeks | F | P | P | P | P | P | P | P |
| 16 weeks | F | P | P | P | P | P | P | P |
| 24 weeks | F | P | P | P | P | P | P | P |
| Stability | | | | | | | | |
| (a) Dry storage at 50° C. | | | | | | | | |
| 2 Weeks | St | St | St | St | St | St | St | St |
| 4 Weeks | PS | " | " | " | " | " | " | " |
| 8 Weeks | | " | " | " | " | " | " | " |
| 16 Weeks | | " | " | " | " | " | " | " |
| 24 Weeks | | " | " | " | " | " | " | " |
| (b) Cycling −16° C. to +50° C. | | | | | | | | |
| 1 Cycle | PS | St | St | St | St | St | St | St |
| 32 Cycle | | " | | " | " | " | " | " |

P = Passing F = Failing PS = Phase Separation St = Stable

In the Examples detailed in Table 2

Stabilizer A is 1-phenylazo-2-naphthol (Formula I)

Stabilizer B is 1-[4'-o-tolylazo)-o-tolylazo]-2-naphthol (Formula II)

Stabilizer C is N-phenyl-α-naphthylamine (Formula III)

Stabilizer D is N-phenyl-β-naphthylamine (Formula IV)

Stabilizer E is the condensation product of one mole of 1,4-dichloroanthraquinone with two moles of p-toluidine, (1,4 bis-(p-toluidine) anthraquinone) (Formula V)

Stabilizer F is a polymer of 2,2,4-trimethyl-1,2-dihydroquinoline (Formula VI).

All the Examples containing stabilising agent show improved stability. Examples 4 to 8 inclusive using a combination of the stabilising agent and gum and Examples 10 to 16 which included different stabilizer but no thickener showed satisfactory cap-sensitivity and stability after six months of hot/dry ambient storage and also under temperature cycling conditions they remained stable even after 32 cycles.

The above Examples illustrate that cap-sensitive explosives of the water-in-oil emulsion type having a reasonably high velocity of detonation, containing no self explosive/detonation catalyst other than occluded gas, can be made in accordance with the invention. The explosive compositions disclosed herein are sensitive to initiation by at least a No. 6 strength commercial detonator/blasting cap and are suitable for small and large diameter application as well as for bulk loading operations in large diameter boreholes and could also be used as 'boosters' for initiating less sensitive commercial blasting explosives such as booster sensitive water-gel slurries and Ammonium Nitrate-Fuel Oil (ANFO) mixtures.

It will be apparent to those skilled in the art that many other modifications, substitutions, combinations and sub-combinations of ingredients and procedures are possible within the scope of the invention.

We claim:

1. An improved water-in-oil emulsion explosive composition which comprises (i) 5 to 30% by weight of water;

(ii) 3 to 15% by weight of a water-insoluble, emulsifiable, liquid or liquefiable carbonaceous fuel;

(iii) 20 to 80% by weight of inorganic oxidiser salt;

(iv) optionally 0.02 to 0.5% by weight of gassing agent;

(v) 0.5 to 4% by weight of emulsifier; and (vi) optionally, water- and/or fuel-soluble thickening agent, flame-quenching coolant and/or metallic particulate fuel characterised in that the composition also contains;

(vii) 0.02 to 2% by weight of a stabiliser selected from the group consisting of organo-sulphur compounds, organic compounds containing quaternary nitrogen, phenolic compounds and substituted derivatives thereof, dihydroxybenzenes, quinones, unsubstituted and substituted aryl diazo compounds, unsubstituted and substituted aryl amines and salts thereof, unsubstituted and substituted quinolines and mixtures of any two or more of said stabilisers.

2. A composition as claimed in claim 1 wherein the stabiliser is selected from the group consisting of thiocarbamides and derivatives thereof; mercaptans and derivatives thereof; alkyl and aryl quaternary ammonium salts; alkyl and aryl pyridinium salts; styrenated phenols; aryl diazo compounds of the general formula $$X_1Ar_1-N=N-Ar_2X_2 \text{ and } X_1Ar_1-N=N-\underset{\underset{X_2}{|}}{Ar_2}-N=NAr_3X_3$$

wherein $Ar_1$, $Ar_2$ and $Ar_3$ are aryl groups which may be the same or different, and $X_1$, $X_2$ and $X_3$ are hydrogen, hydroxyl or alkyl groups and may be the same or different; secondary aryl amines and diamines of the general formula $$Ar_1-\underset{\underset{H}{|}}{N}-Ar_2,\ X_1Ar_1-\underset{\underset{H}{|}}{N}-Ar_2X_2,\ H_2N-Ar-NH_2 \text{ and}$$

$$Ar_1\underset{\underset{H}{|}}{N}-Ar-\underset{\underset{H}{|}}{N}Ar_2$$

wherein Ar, $Ar_1$ and $Ar_2$ are aryl groups which may be the same or different $X_1$ and $X_2$ are selected from the group consisting of hydrogen, hydroxyl and alkyl groups and may be the same or different, and mixtures of any two or more of said stabilisers.

3. A composition as claimed in claim 1 wherein the stabiliser is selected from the group consisting of thiourea; hydroquinone; benzoquinone; naphthaquinone; anthraquinone; 1-phenylazo-2-naphthol;

1-[(4'-o-tolylazo)-o-tolylazo]-2-naphthol;

N-phenyl-α-naphthylamine; N-phenyl-β-naphthylamine;

the condensation products of 1,4-dichloroanthraquinone with p-toluidine; 2,2, 4-trimethyl-1, 2-dihydroquinoline and polymers thereof; and mixtures of any two or more of said stabilisers.

4. A composition as claimed in claim 1 which contains 0.05 to 1% by weight of thickening agent selected from the group consisting of natural and synthetic gums and synthetic polymeric hydrocolloids.

5. A composition as claimed in claim 4 wherein the thickening agent is selected from the group consisting of guar, karaya, acacia, arabic and tragacanth gums and polyacrylamide and mixtures of any two or more thereof.

6. A composition as claimed in claim 1 wherein the carbonaceous fuel is selected from the group consisting of petroleum oils, vegetable oils, refined mineral oils, dinitrotoluenes and mixtures of any two or more thereof.

7. A composition as claimed in claim 1 wherein the gassing agent is selected from the group consisting of sodium nitrite and N,N'-dinitroso pentamethylene tetramine (DNPT).

8. A composition as claimed in claim 1 wherein the emulsifier is selected from the group consisting of sorbitan mono-laurate, sorbitan mono-oleate, sorbitan sesquioleate, sorbitan trioleate, sorbitan monostearate, sorbitan tristearate, mono-and diglycerides of fat forming fatty acids, soya lecithin, condensation products of hydroxy stearic acid and polyethylene glycol 2-(8-heptadecenyl)-4,4'-bis-(hydroxymethyl)-2-oxazoline and mixtures of any two or more thereof.

9. A composition as claimed in claim 1 wherein the oxidiser salt comprises a salt selected from the group consisting of ammonium nitrate, calcium nitrate, sodium nitrate, potassium nitrate and mixtures of any two or more thereof.

10. A method for the preparation of an improved water-in-oil emulsion explosives composition as claimed in claim 1 which comprises the steps of premixing the water-soluble ingredients (other than the gassing agent) in water into a first premix and the oil-soluble ingredients in the carbonaceous fuel into a second premix, heating the first premix till a clear solution is obtained, heating the second premix separately to about the same temperature to which the first premix is heated, blending the first and second premixes at the same temperature with stirring in a conventional mixer until a uniform mixture results, cooling down to 40° C. or less, adding the gassing agent into the mixture, and stirring the final mixture till the gassing agent is uniformly dispersed.

* * * * *